US008065817B2

(12) United States Patent
LeVert et al.

(10) Patent No.: US 8,065,817 B2
(45) Date of Patent: Nov. 29, 2011

(54) CUSHIONING APPARATUS FOR AMBULATORY USE

(76) Inventors: Francis Edward LeVert, Knoxville, TN (US); David Krafsur, Fort Collins, CO (US)

( * ) Notice: Subject to any disclaimer, the term of this patent is extended or adjusted under 35 U.S.C. 154(b) by 429 days.

(21) Appl. No.: 12/378,058

(22) Filed: Feb. 11, 2009

(65) Prior Publication Data

US 2010/0199517 A1 Aug. 12, 2010

(51) Int. Cl.
*A43B 13/28* (2006.01)

(52) U.S. Cl. ..... 36/27; 36/28; 36/3 R; 36/3 B

(58) Field of Classification Search ..... 36/27, 28, 36/3 R, 3 B, 7.8, 38
See application file for complete search history.

(56) References Cited

U.S. PATENT DOCUMENTS 733,167 A * 7/1903 Denton ..... 36/3 B
819,449 A * 5/1906 Otterstedt ..... 36/3 B
904,891 A * 11/1908 Otterstedt ..... 36/3 B
1,027,659 A * 5/1912 Lage ..... 36/35 R
1,194,152 A * 8/1916 Douglas ..... 36/28
1,858,833 A * 5/1932 Leach ..... 36/7.8
1,870,114 A * 8/1932 Heller ..... 36/3 R
2,086,790 A * 7/1937 Wroten ..... 36/3 R
4,322,893 A * 4/1982 Halvorsen ..... 36/43
5,343,637 A * 9/1994 Schindler ..... 36/28
6,282,814 B1 * 9/2001 Krafsur et al. ..... 36/27
6,996,922 B2 * 2/2006 Ryoo ..... 36/7.8
7,055,264 B2 * 6/2006 Gallegos ..... 36/3 B
7,441,347 B2 * 10/2008 LeVert et al. ..... 36/27
7,600,330 B2 * 10/2009 Chen ..... 36/27
7,735,240 B2 * 6/2010 Lee ..... 36/27
7,937,853 B2 * 5/2011 Kwon et al. ..... 36/27
2002/0174567 A1 * 11/2002 Krafsur et al. ..... 36/27
2003/0126760 A1 * 7/2003 LeVert et al. ..... 36/27
2009/0107006 A1 * 4/2009 Ahn et al. ..... 36/27

* cited by examiner

*Primary Examiner* — Marie Patterson

(57) ABSTRACT

According to the principles of the first embodiment of the present invention, a midsole of a shoe comprising an integral midsole, an outer sole with transparent discs, a board last of tractable stiffness; a mechanical spring located within the midsole; and, an upper shoe body. The shoe being capable of providing line-of-sight viewing of the internally mounted contrivances for structural monitoring throughout the life of the shoe so as to improve durability, process of making comfort and acceptability.

11 Claims, 6 Drawing Sheets

CUSHIONING APPARATUS FOR AMBULATORY USE

CROSS REFERENCE OF RELATED APPLICATIONS

Pursuant to 35 U.S.C. 119, the benefit of priority from provisional Application No. 61/063,833 with filing date Feb. 7, 2008 is claimed for this Non-Provisional Application.

TECHNICAL FIELD OF THE INVENTION

The present invention relates generally to a shock resistant shoe.

BACKGROUND AND OBJECTIVES OF THE INVENTION

Shoes that contain mechanical springs or other contrivances in a prescribed volume between the foot and the surfaces on which a person is walking or running are known to develop functional problems that results in their nonuse or failure of the devices inserted in the sole to increase comfort, reduce fatigue or increase the athlete performance of the wearer. There are shoes with contrivances in the midsole that provide for cushioning of the foot against shock during a foot strike. This shock reduction can be achieved by various design and engineering techniques. Typically, inventors make use of a multiplicity of metal small diameter wave springs or cone springs. It is a primary objective of this invention to provide a shoe that uses large diameter metal cone springs in the midsole mounted in a manner such that the large diameter terminal end of the spring is proximate the board last. A second objective is provide integral wrist pin throughhole on mount discs in the out sole that allows for viewing of the spring from without while simultaneously providing a lower bearing surface for each in contact therewith. A still further objective is to provide shoe with an insole with stiffness greater than the spring rate of the selected springs such that the insole will not deform against the foot while bearing against the springs. Other objectives will become obvious during the course of the detailed description of the shoe of this invention.

BRIEF DESCRIPTION OF THE FIGURES

1)

Figure 1:
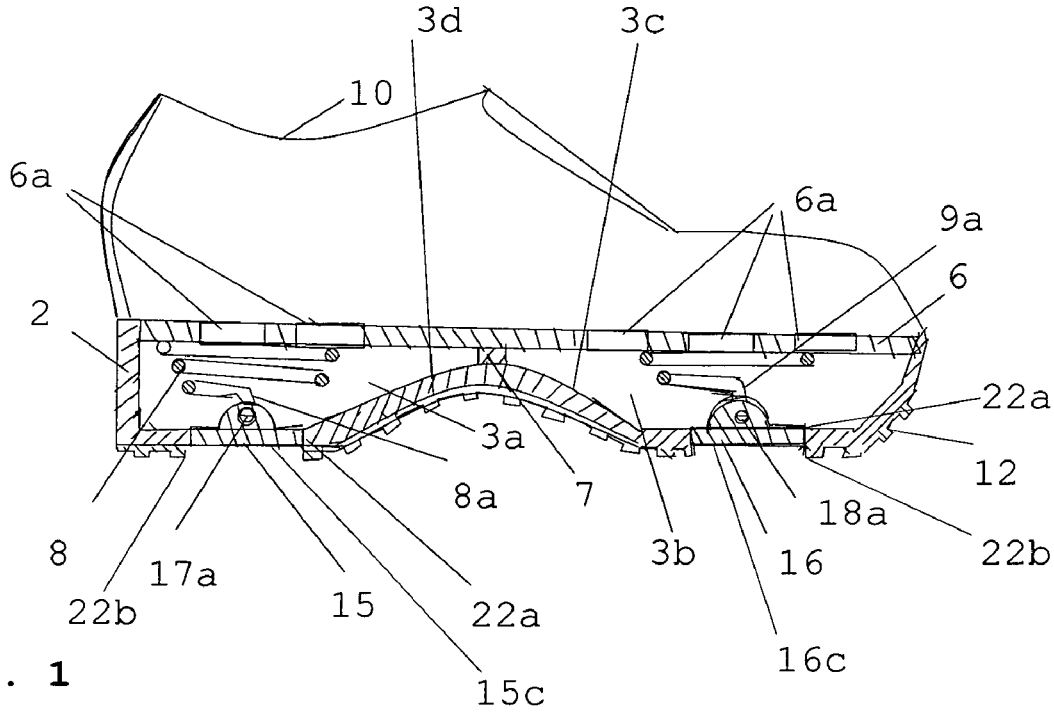
FIG. 1 shows a side view of the first embodiment of the midsole with a cone spring mounted in a disc in the midsole.
Figure 1A:
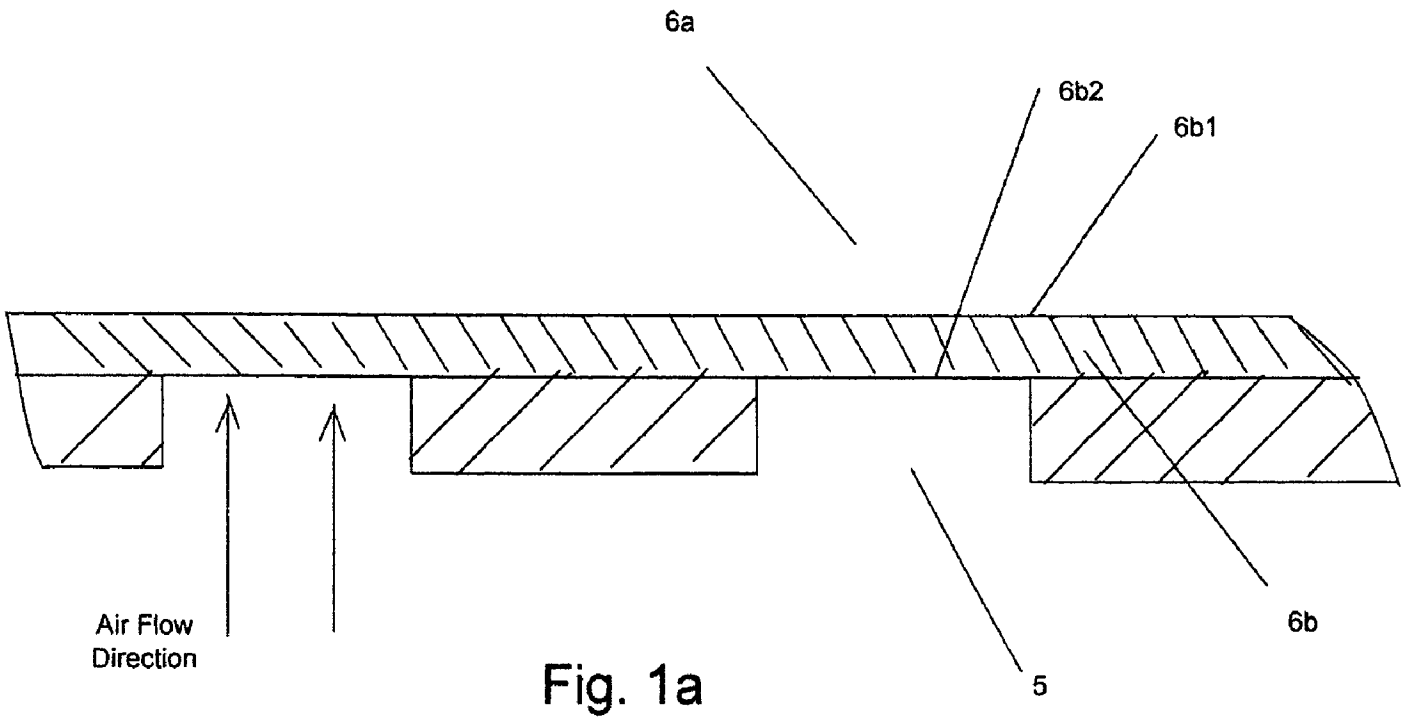

2) FIG. 1*a* gives a sectional view of a Strobel last that can be used to replace the board last of FIG. 1.

Figure 2:
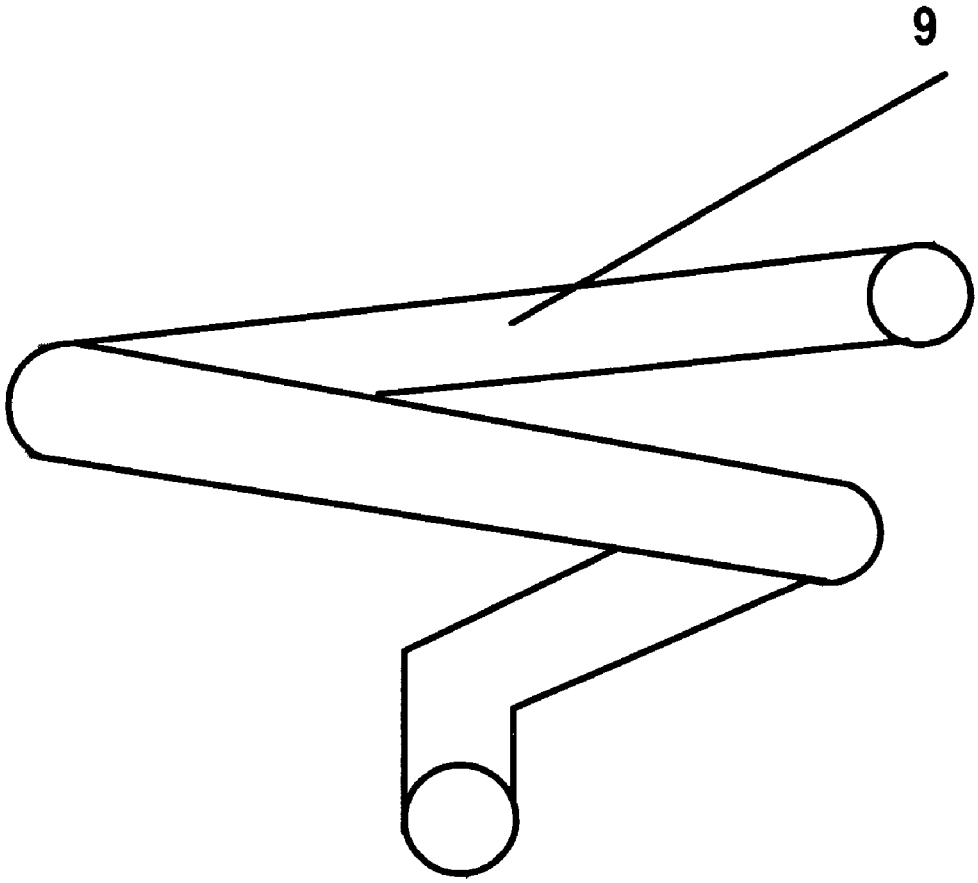

3) FIG. 2 presents a side view of the cone springs of the first embodiment of this invention with small terminal end terminated wrist pin like.

Figure 3:
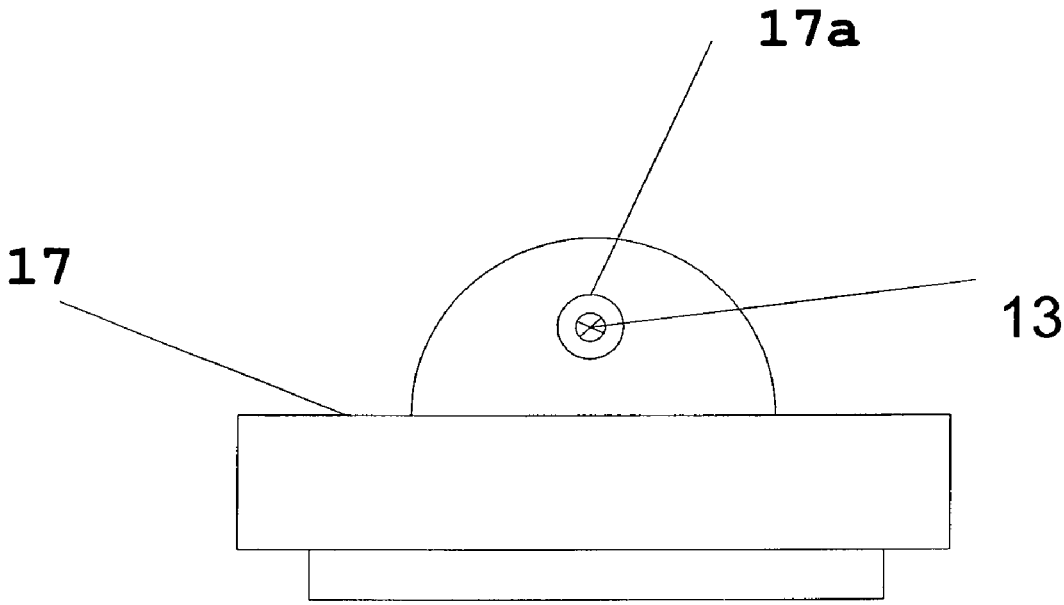

4) FIG. 3 presents a side view of the disc of FIG. 1 having an eyelet for accepting the noncircular wrist pin-like small terminal end of the cone spring of FIG. 2.

Figure 4:
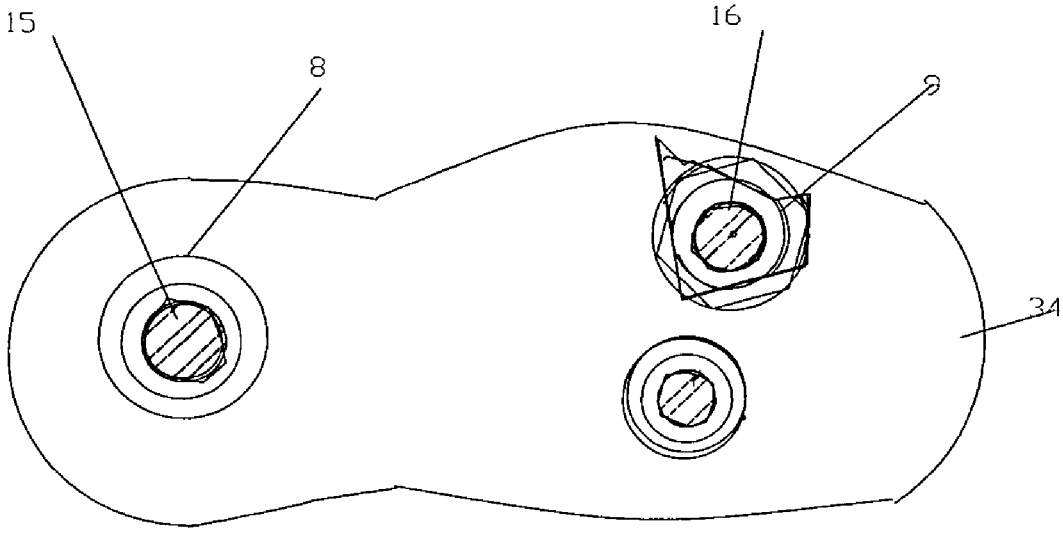

5) FIG. 4 presents a top view of a second embodiment with a single cone spring in the heel and two cone springs in the forefoot.

Figure 5:
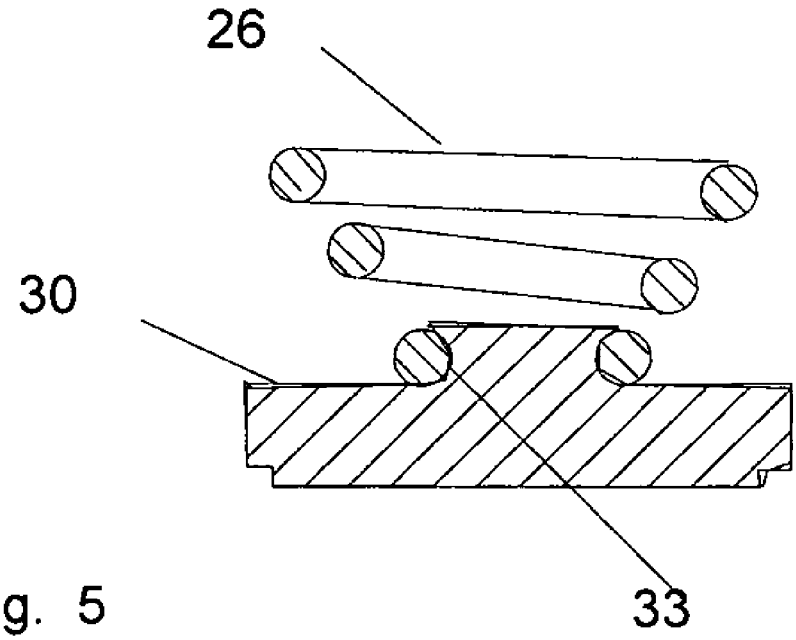

6) FIG. 5 shows a cone spring with its circular small terminal end rigidly mounted on a disc for use in the ball and heel area of a third embodiment of the shoe of this invention.

DETAILED DESCRIPTION OF THE PREFERRED EMBODIMENTS

The present invention will be described below with reference to the accompanying figures.

Referring to the drawings of FIG. 1 a shoe in accordance with the present invention comprises: midsole assembly 2; an outsole 12; and, an upper 10. The midsole assembly 2 comprises volumes 3*a* and 3*b* which are isolated from each other by divider 7 cooperating board last 6; mechanical springs 8 and 9 located within the separate internal volumes 3*a* and 3*b* of the midsole assembly 2; and, transparent discs 15 and 16 which are connected pivotally to the small terminal ends 8*a* and 9*a* of springs 8 and 9.

The divider 7 which extends continuously from surface 3*c* of the bottom interior of midsole assembly 2 up to the board last 6 where it is sealed therein to prevent the flow of fluid between volumes 3*a* and 3*b*. In this invention, the divider 7 is made of the same material as the midsole EVA (i.e., ethylene-venal-acetate). The divider could be made of extremely flexible material such that no flow of fluid occurs from volume 3*a* to 3*b*. That is, the divider may be allowed to grow toward the ball of the foot region of the shoe in response to pressure applied to the board last in the heel region during a foot strike. Likewise it would be allowed to expand in a rearward direction when volume 3*b* is pressurized. Further, portions of board last 6 above volumes 3*a* and 3*b* contain a multiplicity of through slits 5. The slits 5 allow air to resistively escape toward the volume commonly occupied by the sock liner of the shoe from volumes 3*a* and 3*b* during the natural movement of the feet during walking or running. In FIG. 1 outsole 12 is mechanically attached to midsole surface 3*d* by ordinary adhesive 14 which is not shown in FIG. 1. In the first embodiment of the shoe of this invention, the outsole 12 is composed of abrasive resistant polymeric material. The outer surface 3*d* of midsole assembly 2 to which outsole 12 is adhesively attached via of adhesive 14 combine via mating through holes 22*a* and 22*b* in the bottom surface 3*d* of midsole assembly 2 and outsole 12, respectively, to mountingly accept transparent discs 15 and 16 which extends essentially through surface 3*d* and outsole 12. Throughhole 22*b* in outsole 12 are countersunk to allow line-of-site viewing of the discs but prevent full penetration of throughhole 22*b* when the discs are inserted therein. That portion of the first surfaces 15*c* and 16*c* of discs 15 and 16 that are in contact with the countersunk portions of throughhole 22*b* is attached thereto by adhesive 14 (not shown in FIG. 1). The cylindrical surfaces of discs 15 and 16 are also attached to the cylindrical surfaces of throughhole 22*a* by adhesive 14 (not shown in FIG. 1).

Discs 15 and 16 are attached to the shaped wrist pin like ends 8*a* and 9*a* of springs 8 and 9, respectively, via eyelets 17*a* and 18*a* in male protrusion integrally attached to discs 15 and 16. In this invention, the discs 15 and 16 are made of transparent plastics. They could, however, be made of opaque polymeric material. Also, while the discs 15 and 16 have protruding elements eyelets designed to accept the wrist pin like terminal ends of the cone springs of this invention, they could be designed with a groove in a prism integrally connected to the discs to accept the full length of the wrist like ends of the cone springs with rotational snap certainty. The adhesive 14, when cured, has tear strength greater than 200 lbf and is designed to be resistant to corrosion by liquids commonly encountered in the workplace and during exercise or play. The thickness of Outsole 12 was selected such that it does not restrict the flextive motion of the outer sole required for comfort during the normal rolling motion of a shoe during walking and running. In the invention shown in FIG. 1, the discs 15 and 16 are viewable from the bottom of the outsole 12. The outsole could be assembled with an outsole that does not have the through holes of FIG. 1.

In FIG. 1, the side walls of the midsole on the medial and lateral are design such that they do not affect the natural function of the springs. The springs 8 and 9 are held rotatably firm at their small shaped ends 8*a* and 9*a* in wrist pin eyelets 17*a* and 18*a*, respectively, by ordinary pin fasteners not shown in FIG. 1. The motion about the central axis 13 of throughhole 17*a* and 18*a* is such that the forward rolling motion of a foot strike is not impeded. With the shaped small ends 8*a* and 9*a* of springs 8 and 9 inserted in the throughhole 17*a* and 18*a*, the springs are restricted in the lateral to medial directions. Returning to FIG. 1, the broad last 6 is presented a single polymeric material, however, it could, as shown in FIG. 1*a*, be assembled as laminated element 6*a* of FIG. 1*a*, as having a first sheet 6*b* with first and second planar surfaces 6*b*1 and 6*b*2, respectively, composed of a thin flexible "cloth like" polymeric material with its second surface adhesively attached to a less flexible material extending over its essentially the planar second surface. The first sheet could be made of one of many materials or a composite thereof designed to allow the flow of air there through. The less flexible material may be fabricated with or without slits 5 suspended between the inner walls of the proximate cavities.

FIG. 2 shows a side view of one of the cone springs used in the first embodiment of the shoe of this invention. Cone spring 9 is of identical design and spring steel material type.

FIG. 3 presents a side view of the discs used to rotatably fix the ends of the springs of the first embodiment of the present invention. The discs are designed to allow the cone springs of FIG. 1 to rotate about the central axis 13 defined by eyelets 17*a* and 18*a* when small shaped ends 8*a* and 9*a* are inserted therein.

In the present invention, the shoe is made in a board last construction. However, it would also be possible to make the shoe of a breathable strobel lasted construction in which the abrasive polymeric material is attached via adhesive to the bottom side of the strobel last to provide an equivalent stiffness bearing surface and through slits for the resistive escape of air from volumes 3*a* and 3*b*.

FIG. 4 presents a bottom view of a second embodiment of this invention with a single cone spring in the heel and two cone springs in the forefoot. The outsole 34 and the midsole 35 accepts two transparent discs 16 and 16*e* in the forefoot area along with cooperate sized cone springs.

Even though the springs 8 and 9 are terminated at their small ends 8*a* and 9*a* with essentially a 90 degree wrist like turn relative to a tangent line to the spiral direction of the last turn, they could have been terminated at their small ends in a normally accepted manner cone springs. The second embodiment of the shoe shown in FIG. 1 of this invention teaches a shoe where cone springs are mounted with their small ends fixably mounted on the transparent discs. FIG. 5 shows a cone spring 26 rigidly mounted on a transparent disc 30 with permanent adhesive 33 as shown in FIG. 5

The operation of the shoe of this invention will now be discussed. The shoe of this invention is engineered such that the springs mounted in the ball and heel regions of the shoe can pivot in the forward and rearward directions during a foot strike while at the same time providing cushioning of the foot. During a foot strike the spring in a given vacuity forcing the air in that vacuity to flow upward through the throughhole in the laminated closure 6*a* attached to midsole 2 or the board last 6. When the thick broad 6 is used with the midsole 2 the durometer of the EVA of the midsole is chosen such that it minimally interferes with the spring function of the shoe. Alternatively when the laminated closure system is used the thick broad last material is suspended from the walls of the midsole 2 via the Strobel last.

We claim:

1. An article of footwear having an upper and a sole structure secured to said upper, said sole structure comprising:

a midsole element having at least one open surface extending substantially the length of the sole structure with a cavity positioned therein that defines the heel or ball regions of said midsole element;

a cone spring, having a large and a noncircular terminal small end, mounted with the small end of said cone spring pivotally attached to anchoring means that is attached to the second surface of the midsole with permanent means for preventing movement;

closure means attached to said one open surface with a plurality of throughholes that allow fluid flow in the axial direction of the central axis of said cone spring mounted in said cavity; and an outsole attached to the midsole.

2. The article of footwear in claim one wherein the midsole element is formed with a first cavity in the heel region and a second cavity in the ball region of the midsole with said cavities juxtaposed next to each other with a non eructative flow element therebetween that prevents erucative flow between said cavities.

3. The article of footwear in claim 2 wherein the cone spring in the first cavity is mounted with its small end directed toward the outer sole and a second cone spring mounted in the heel region.

4. The article of footwear of claim 1 wherein the closure means having a polymeric element consist of a material element whose spring constant is greater than that of the cone spring disposed there next to in the communicating cavity.

5. The article of footwear of claim 1 wherein anchoring means is a disc with a protruding male part with a circular throughhole that accepts the noncircular terminal end of the small end of said cone spring and permit the rotation of the cone spring only in a plane that is perpendicular to a line co-linear with the axis of the throughhole in the male protrusion of the disc.

6. The article of footwear of claim 1 wherein anchoring means is a circular groove designed to accept a substantial portion of the first turn of an ordinary small end of a standard cone spring.

7. The article of footwear of claim 1 wherein the anchoring means is a straight groove formed in a solid prism protrusion designed to accept a substantial portion of the noncircular terminal end of the small end of the cone spring and permit the rotation of a plane that contains the axial center of the cone spring only in a plane that is perpendicular to a line co-linear with the central axis of the groove.

8. The article of footwear in claim 1 closure means attached to said open first surface of the midsole with a plurality of throughholes is a polymer with a spring constant greater than that of the cone spring deployed functionally thereagainst.

9. The article of footwear in claim 1 wherein closure means attached to said open first surface with a breathable Strobel last laminated with a polymeric material attached to the open first end of the midsole.

10. The article of footwear in claim 1 wherein closure means is attached to said open first surface with a breathable Strobel last laminated with a polymeric material system with prescribed throughholes for the flow of air through the laminated Strobel last—polymeric system.

11. An article of footwear having an upper and a sole structure secured to said upper, said sole structure comprising:

a midsole element having at least one open surface extending substantially the length of the sole structure with a first cavity positioned in the forward region of the midsole separated from a second cavity in the heel region of the midsole by a protrusion that extends lateral-to-medial having a height that extends from a second surface to a plane that includes the top of the open surface;

a first cone spring, having a large and a small end, mounted with the small end of said cone spring pivotally attached to anchoring means that is attached to second surface of the midsole in said first cavity and a second cone spring mounted in the second cavity with anchoring means for permitting motion in the fore and aft directions;

closure means attached to said to open first surface with a plurality of throughholes that allow fluid flow in the axial direction of the central axis of said first and second cone springs mounted in said cavities of the midsole; and an outsole attached to the second surface of the midsole.

* * * * *